US007313849B2

(12) United States Patent
Liu

(10) Patent No.: US 7,313,849 B2
(45) **Date of Patent: *Jan. 1, 2008**

(54) FASTENER FOR A LACE

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 133 days.

This patent is subject to a terminal disclaimer.

(21) Appl. No.: 11/210,928

(22) Filed: Aug. 24, 2005

(65) Prior Publication Data

US 2006/0200953 A1 Sep. 14, 2006

(30) Foreign Application Priority Data

Mar. 11, 2005 (TW) ..... 94107538 A

(51) Int. Cl.
*A43C 7/08* (2006.01)

(52) U.S. Cl. ..... 24/712.5; 24/712.1

(58) Field of Classification Search ..... 24/68 SK, 24/115 R, 136 K, 136 R, 712, 712.1, 712.2, 24/712.5, 713.1, DIG. 33; 36/50.1, 50.5
See application file for complete search history.

(56) References Cited

U.S. PATENT DOCUMENTS 1,137,381 A * 4/1915 Burket ..... 24/712.4
1,832,738 A * 11/1931 Ray ..... 24/712.5
2,035,174 A * 3/1936 McIlhenny ..... 24/712.6
3,808,645 A * 5/1974 Chow ..... 24/71 SK
4,157,622 A * 6/1979 Carlyle ..... 36/50.1
5,335,401 A * 8/1994 Hanson ..... 24/712.5
6,796,009 B1 * 9/2004 Liu ..... 24/712.6
6,817,070 B1 * 11/2004 Liu ..... 24/712.5
6,938,307 B2 * 9/2005 Liu ..... 24/712.5
7,036,193 B1 * 5/2006 Liu ..... 24/712

* cited by examiner

*Primary Examiner*—David Bagnell
*Assistant Examiner*—Ruth C Rodriguez
(74) *Attorney, Agent, or Firm*—Merchant & Gould P.C.

(57) ABSTRACT

A fastener for a lace includes a fastening body and a pull unit. The fastening body includes a base, and at least one clamp assembly having a substantially U-shaped member which have two pivoting ends pivotally connected to the base to define an opening with the base, and a clamp member which is attached slidably to the U-shaped member and which extends across the opening to divide the opening into a first aperture proximate to the base and a second aperture distal from the base. The U-shaped member has a U-bend cooperating with the clamp member to confine the second aperture. The clamp member is slidable along the U-shaped member between a clamping position and a releasing position. The pull unit is connected to the U-shaped member.

11 Claims, 9 Drawing Sheets

FASTENER FOR A LACE

CROSS-REFERENCE TO RELATED APPLICATION

This application claims priority of Taiwanese Application No. 094107538, filed on Mar. 11, 2005.

BACKGROUND OF THE INVENTION

1. Field of the Invention

The invention relates to a fastener, more particularly to a fastener for a lace.

2. Description of the Related Art

Referring to FIG. 1, U.S. Pat. No. 6,796,009 B1 discloses a shoelace fastener including a main body 1, a pull unit 2 secured on the main body 1, and a covering band 3 surrounding the main body 1 and the pulling unit 2. The main body 1 includes a pivot axle 4, and first and second fastener bodies 5, 6 disposed side by side and pivotally interconnected through the pivot axle 4. Each of the first and second fastener bodies 5, 6 is formed with a through hole 501, 601 having a respective hole axis (Z). Each of the first and second fastener bodies 5, 6 is further formed with a respective slot 502, 602 extending in a respective longitudinal direction (X) transverse to the hole axis (Z) and in spatial communication with the through hole 501, 601 in a transverse direction (Y) transverse to the hole axis (Z) and the longitudinal direction (X), and is provided with a respective clamping pin 503, 603 extending in the transverse direction (Y) and movable along the longitudinal direction (X). The pull unit 2 is attached to the first and second fastener bodies 5, 6 through strings 504, 604.

When a manual pulling force is applied on the first and second fastener bodies 5, 6 through the pull unit 2, the first and second fastener bodies 5, 6 are pivotally moved to each other so as to enable movement of the clamping pins 503, 603 toward the pivot axle 4, thereby releasing a shoelace.

Although the shoelace can be fastened and released by the aforesaid shoelace fastener, the main body 1 has a relatively size. Hence, the pull unit 2 is unable to conceal the main body 1 satisfactorily.

SUMMARY OF THE INVENTION

Therefore, the object of the present invention is to provide a lace fastener which has a reduced size, and which is easy to operate.

According to one aspect of this invention, a fastener for a lace includes a fastening body and a pull unit. The fastening body includes a base, and at least one clamp assembly having a substantially U-shaped member which has two pivoting ends pivotally connected to the base to define an opening with the base, and a clamp member which is attached slidably to the U-shaped member and which extends across the opening to divide the opening into a first aperture proximate to the base and a second aperture distal from the base. The U-shaped member has a U-bend which cooperates with the clamp member to confine the second aperture. The clamp member has two opposite ends respectively formed with slots. The U-shaped member has two sliding arms respectively extending through the slots between the base and the U-bend of the U-shaped member. The clamp member is slidable along the U-shaped member between a clamping position in which the clamp member moves toward the U-bend to clamp the lace against the U-bend for maintaining a tightened state of the lace, and a releasing position in which the clamp member moves away from the U-bend to permit loosening movement of the lace. The pull unit is connected to the U-shaped member for pulling the U-shaped member so that the clamp member can slide along the U-shaped member to the releasing position.

According to another aspect of this invention, a fastener for a lace includes a fastening body and a pull unit. The fastening body includes a base and at least one clamp assembly. The base has a plate body provided with a pivot hole. The clamp assembly has a frame member that has a pivoting end inserted pivotally into the pivot hole and that defines an opening, and a clamp member that is attached slidably to the frame member and that extends across the opening to divide the opening into a first aperture proximate to the base and a second aperture distal from the base. The frame member has a U-bend which cooperates with the clamp member to confine the second aperture. The clamp member is slidable along the frame member between a clamping position in which the clamp member moves toward the U-bend to clamp the lace against the U-bend for maintaining a tightened state of the lace, and a releasing position in which the clamp member moves away from the U-bend to permit loosening movement of the lace. The pull unit is connected to the frame member for pulling the frame member so that the clamp member can slide along the frame member to the releasing position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
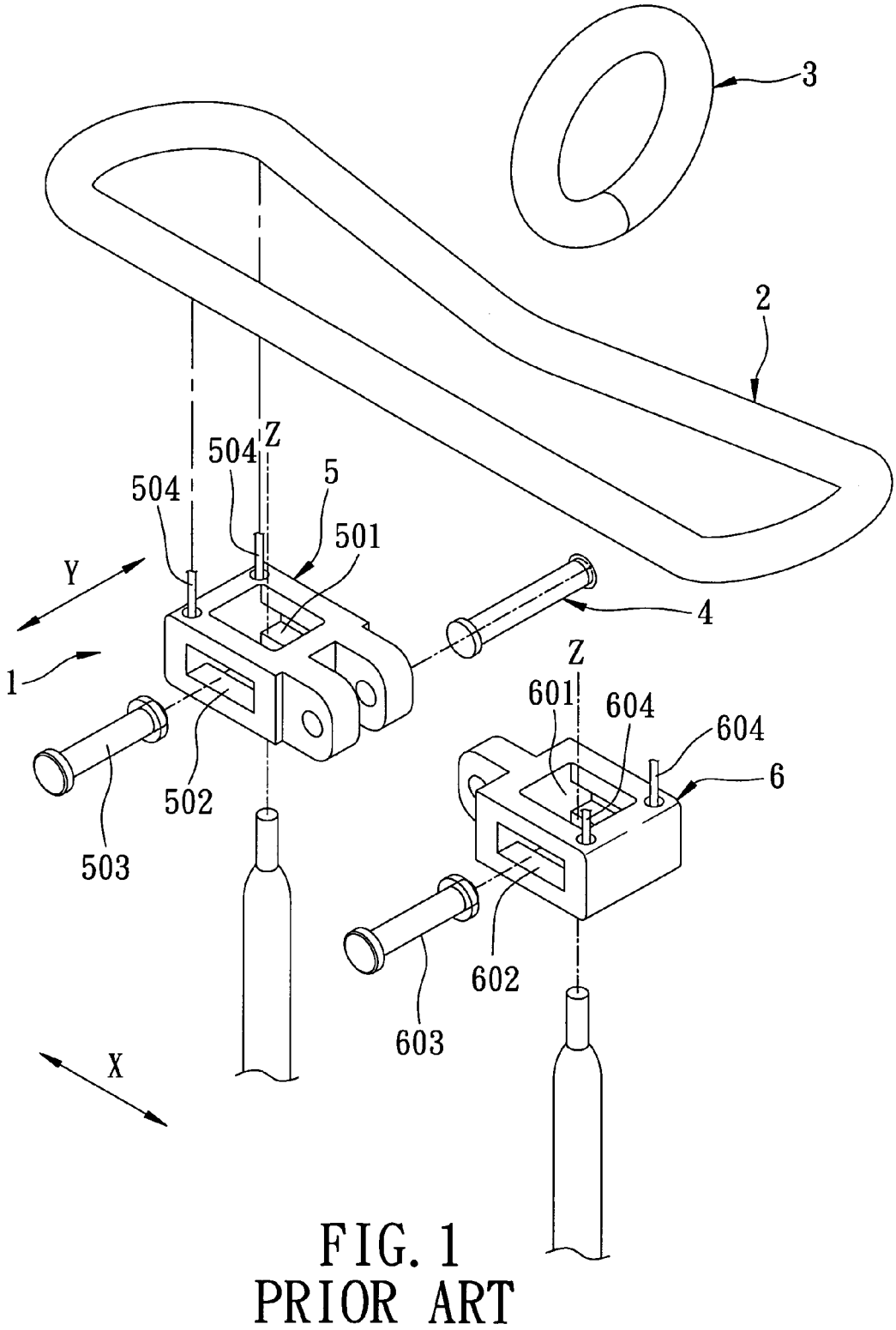
FIG. 1 PRIOR ART
FIG. 1 is an exploded perspective view of a conventional shoelace fastener.

Before the present invention is described in greater detail, it should be noted that like elements are denoted by the same reference numerals throughout the disclosure.

Figure 2:
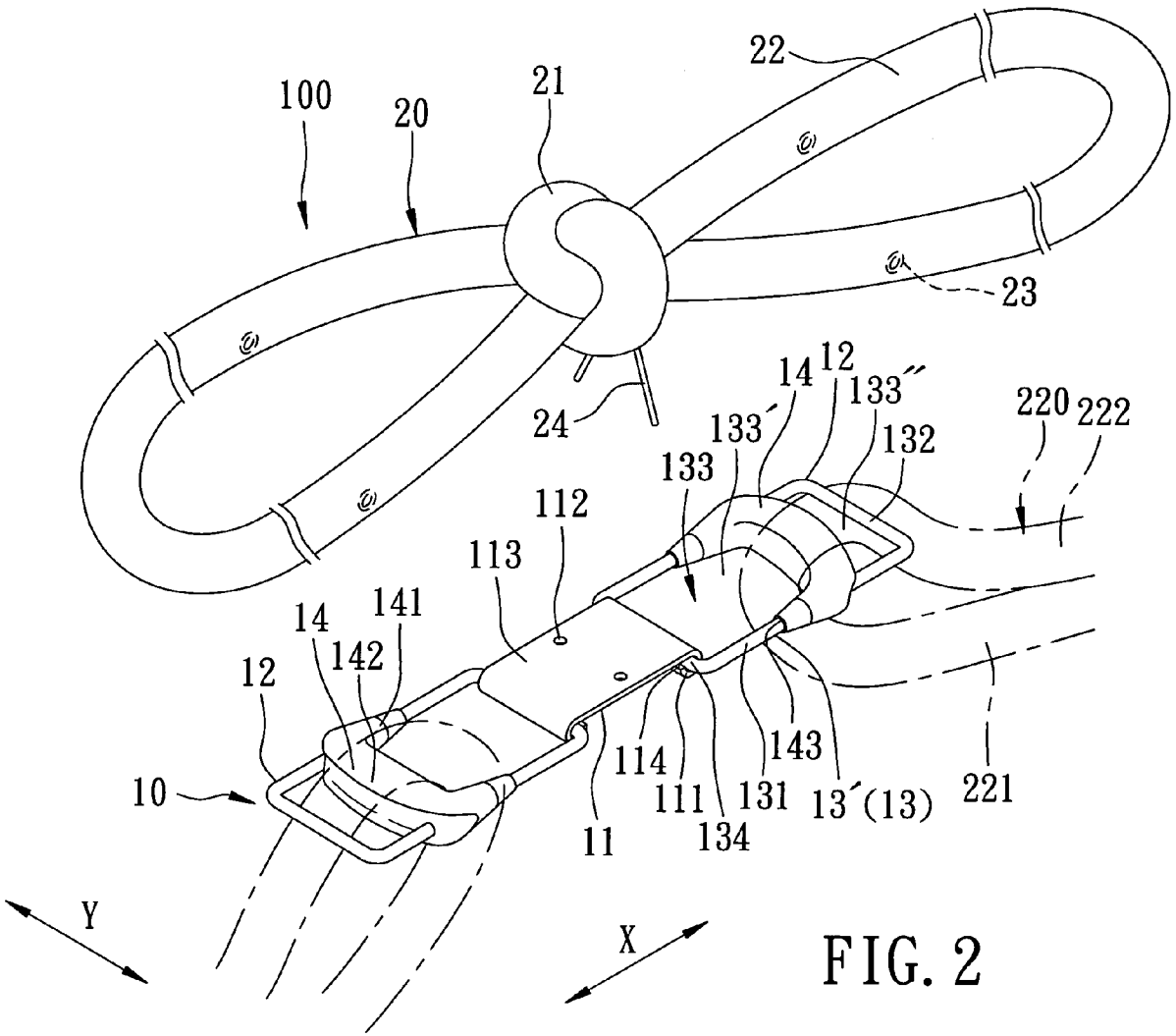
FIG. 2 is a partly exploded, perspective view of the first preferred embodiment of a fastener for a lace according to this invention.
Figure 4:
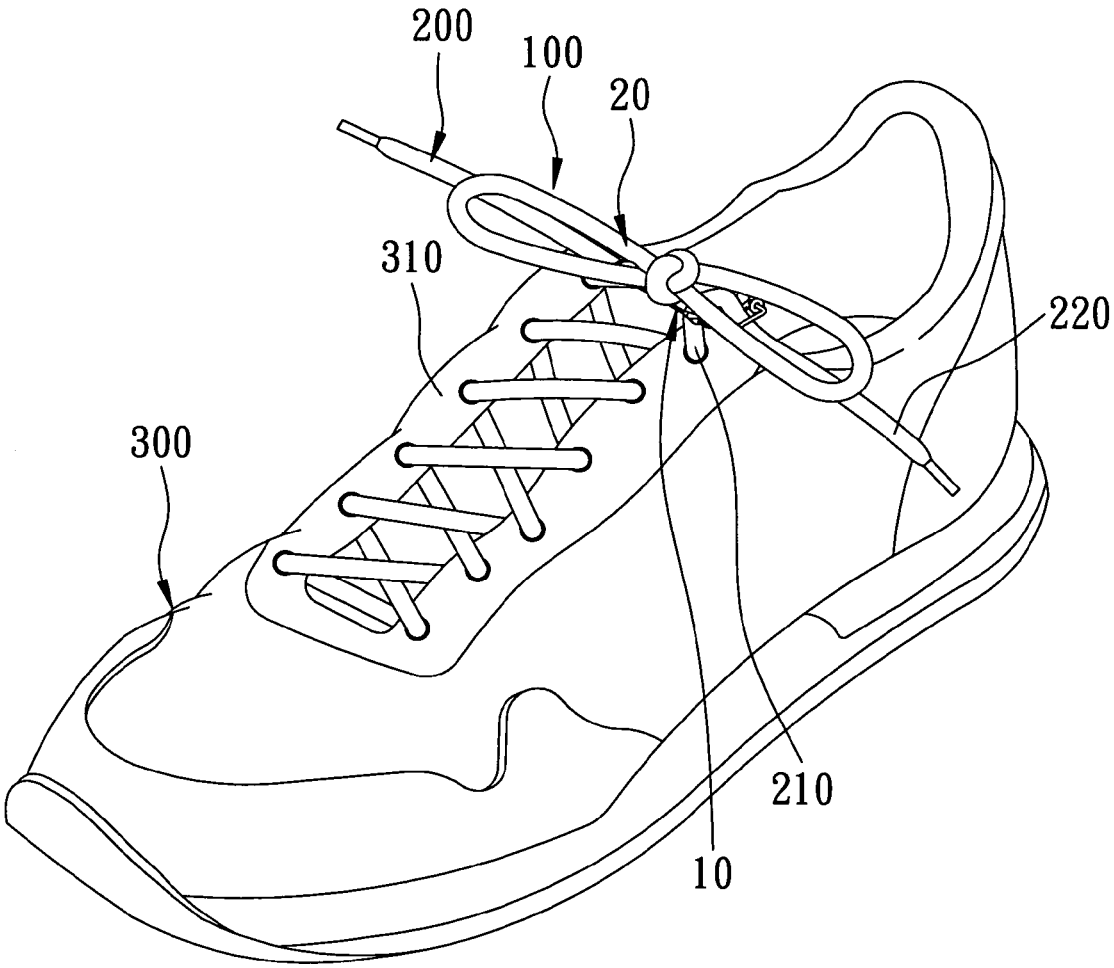
FIG. 4 is a perspective view showing a shoe that incorporates the first preferred embodiment of this invention.

Referring to FIGS. 2 and 4, the first preferred embodiment of a fastener 100 according to this invention is shown to be adapted for use with a shoe which includes a shoe body 300 with a pair of eyelet tabs 310, and a shoelace 200 having an anchoring segment 210 strung on the eyelet tabs 310, and a pair of distal lace segments 220, each of which is connected to the anchoring segment 210 at one end. The fastener 100 includes a fastening body 10 and a pull unit 20. It should be noted herein that, except for FIG. 4, the shoelace fastener 100 is not drawn to scale in the accompanying drawings and is actually illustrated in a magnified form for the sake of clarity. Although the fastener 100 of this invention as exemplified in the preferred embodiments is used together with a shoe, it can also be used in other applications, such as clothes, backpacks, hats, and the like.

The fastening body 10 includes a base 11 and a pair of clamp assemblies 12 disposed in a first direction (X) and pivotally connected to the base 11 at two opposite sides of the base 11.

The base 11 includes a plate body 113 and two opposite edge portions 111 integral with the plate body 113. Each of the edge portions 111 is rolled to form a sleeve defining a pivot hole 114 that extends in a second direction (Y) transverse to the first direction (X). The plate body 113 is formed with two through holes 112 located between the edge portions 111.

Each of the clamp assemblies 12 has a frame member 13' and a clamp member 14. The frame member 13' used in the preferred embodiment is a substantially U-shaped member 13. The U-shaped member 13 is rigid, and has two pivoting ends 134 inserted pivotally into the pivot hole 114 of a corresponding one of the edge portions 111 so as to be pivotally connected to the base 11 and so as to define an opening 133 with the base 11. The clamp member 114 is attached slidably to the U-shaped member 13 and extends across the opening 133 to divide the opening 133 into a first aperture 133' proximate to the base 11 and a second aperture 133" distal from the base 11. The U-shaped member 13 has a U-bend 132 which cooperates with the clamp member 14 to confine the second aperture 133". The U-bend 132 is attached to the pull unit 20. The clamp member 14 is configured in a substantially U-shape, and has two opposite ends 141 respectively formed with slots 143, and a clamping portion 142 extending between the opposite ends 141. The U-shaped member 13 has two sliding arms 131 respectively extending through the slots 143 between the base 11 and the U-bend 132 of the U-shaped member 13.

The clamp member 14 is slidable along the sliding arms 131 of the U-shaped member 13 between a clamping position in which the clamp member 14 moves toward the U-bend 132 to clamp a corresponding one of the distal lace segments 220 of the lace 200 against the U-bend 132 for maintaining a tightened state of the lace 200, and a releasing position in which the clamp member 14 moves away from the U-bend 132 to permit loosening movement of the lace 200.

Furthermore, the first aperture 133' is adapted to receive an entry part 221 of the distal lace segment 220. The second aperture 133" is adapted to receive an exit part 222 of the distal lace segment 220. The clamp member 14 presses the exit part 222 of the distal lace segment 220 against the U-bend 132 of the U-shaped member 13 when the clamp member 14 is in the clamping position.

The pull unit 20 includes a tying knot 21 connected to the base 11 using a connecting string 24 passing through the through holes 112 in the base 11, and a pair of loops 22 extending from the tying knot 21 and connected respectively to the U-shaped members 13 of the clamp assemblies 12. In this preferred embodiment, the pull unit 20 further includes a plurality of anchoring elements 23 for connecting each of the loops 22 of the pull unit 20 to the U-bend 132 of the U-shaped member 13 of the corresponding one of the clamp assemblies 12. Alternatively, each of the loops 22 of the pull unit 20 can be connected to the U-bend 132 of the U-shaped member 13 of the corresponding one of the clamp assemblies 12 by penetrating the U-bend 132 of the U-shaped member 13 through a corresponding one of the loops 22 of the pull unit 20 directly.

Figure 3:
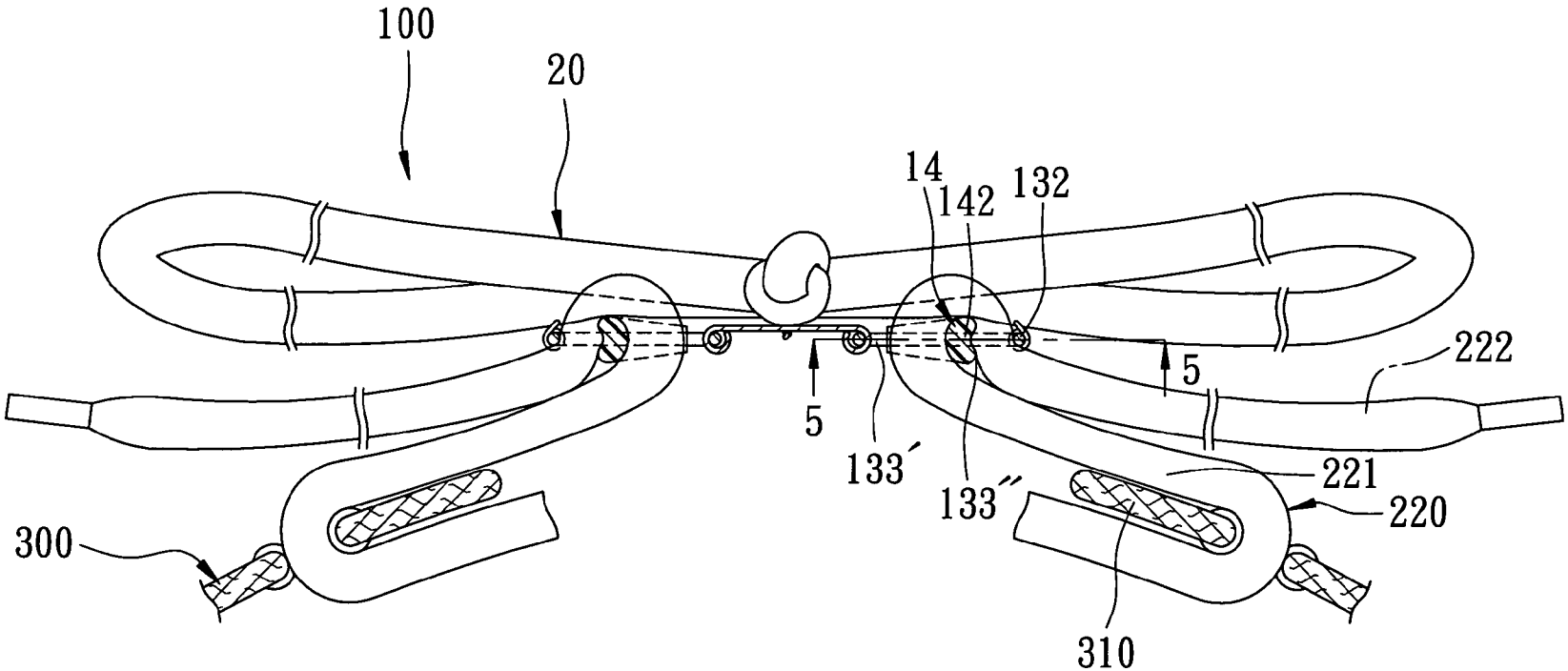
FIG. 3 is a schematic assembled sectional view of the first preferred embodiment to illustrate a tightening operation of a shoe that incorporates the first preferred embodiment.
Figure 5:
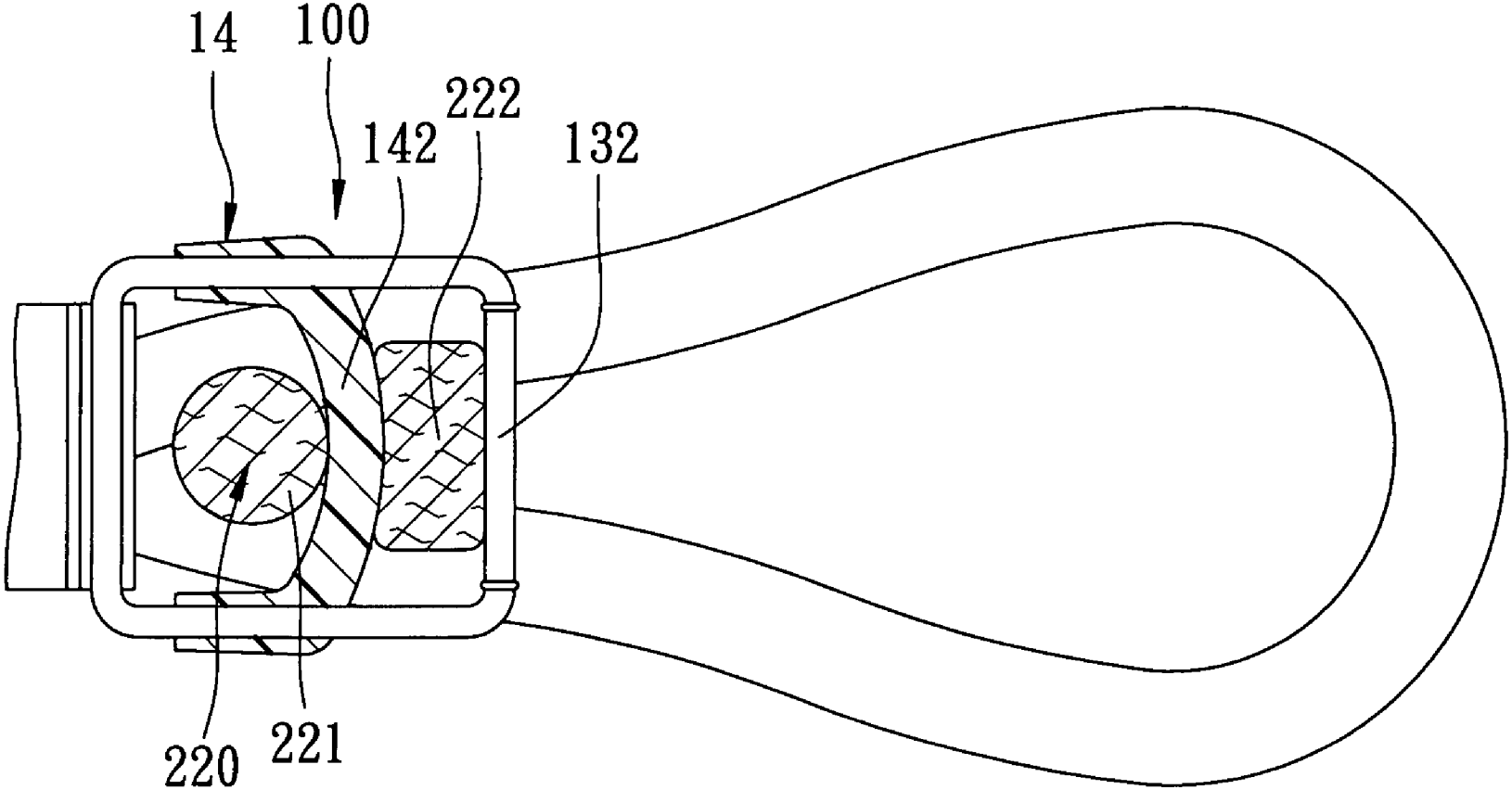
FIG. 5 is a sectional view of the first preferred embodiment, taken along line 5-5 in FIG. 3.

Referring again to FIGS. 3, 4 and 5, in use, each of the distal lace segments 220 is extended through the first aperture 133' of the opening 133, over the corresponding one of the clamp members 14, into the second aperture 133" of the opening 133, and out of the U-bend 132 of the corresponding one of the U-shaped members 13. At the same time, the loops 22, the tying knot 21 and the distal lace segments 220 cooperate to form a double-bow configuration. After a foot (not shown) is slipped into the shoe body 300, the distal lace segments 220 can be pulled apart from each other to tighten the shoe body 300. When the shoe body 300 is tightened, the eyelet tabs 310 are forced apart by the foot in the shoe body 300, thereby applying tension on the shoelace 200. At the same time, each of the clamp members 14 is forced by a corresponding one of the distal lace segments 220 to move toward the U-bend 132 of the corresponding one of the U-shaped members 13 such that each of the distal lace segments 220 is clamped in the clamping position between the corresponding one of the clamp members 14 and the corresponding U-bend 132 for maintaining a tightened state of the shoe (best shown in FIGS. 4 and 5).

Figure 6:
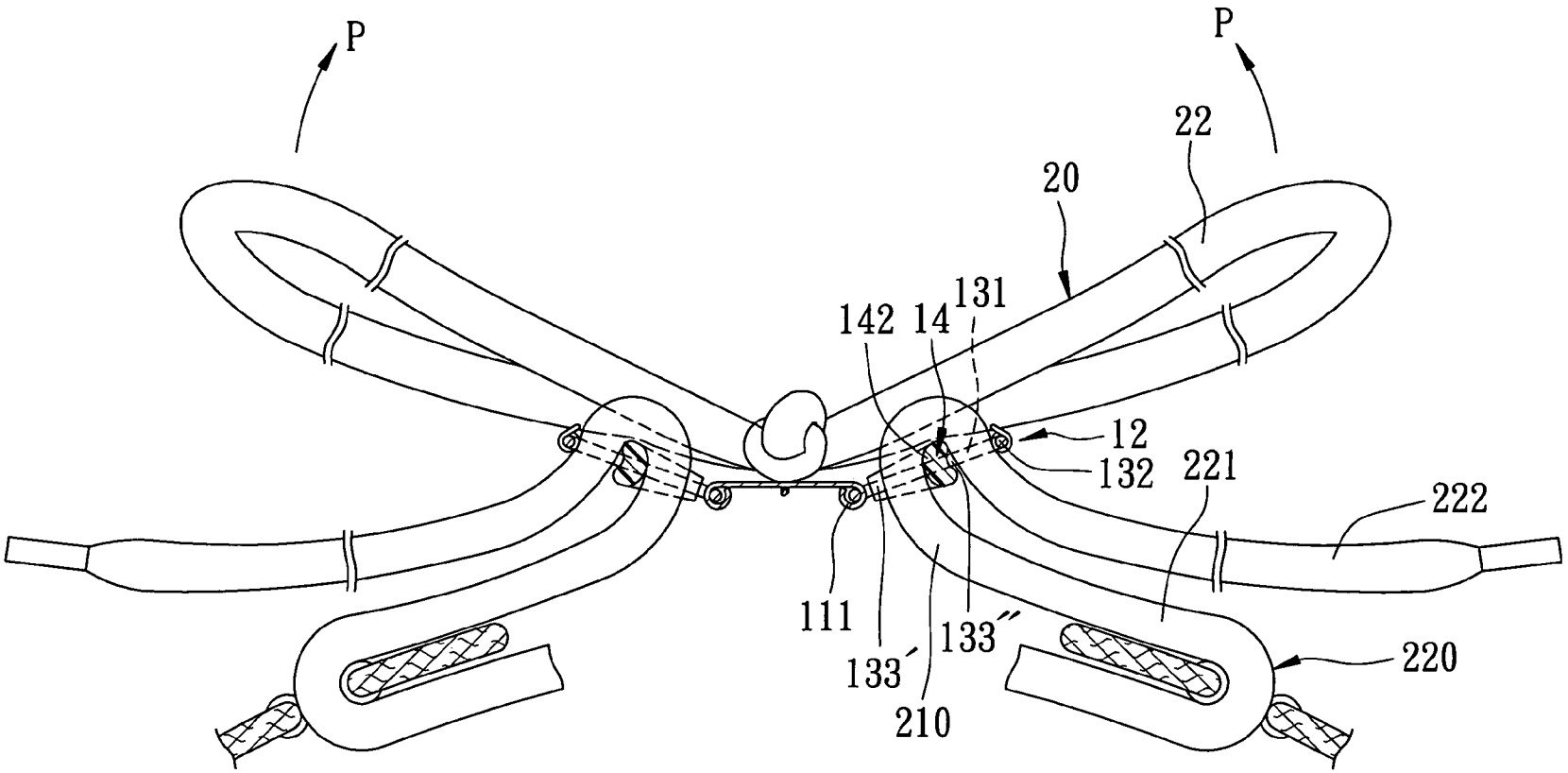
FIG. 6 is a view similar to FIG. 3, illustrating a loosening operation of the shoe.

Referring to FIG. 6, to loosen the shoe body 300, a manual pulling force is applied on the loops 22 of the pull unit 20, as indicated by arrows (P). This results in pivoting movement of the U-shaped members 13 relative to the base 11 toward each other and in movement of each of the clamp members 14 away from the corresponding U-bend 132, thereby releasing the distal lace segments 220 from being clamped by the clamp members 14 against the U-bends 132 so as to permit sliding movement of the distal lace segments 220 for loosening the shoe body 300 accordingly.

In view of the aforesaid, since the shoelace 200 can be loosened by applying a manual pulling force on the loops 22 of the pull unit 20, the fastener 100 of the present invention is easy to operate. Moreover, the size of the fastening body 10 can be designed to be smaller as compared to the prior art so as not to result in an adverse affect on the appearance of the shoe.

Figure 7:
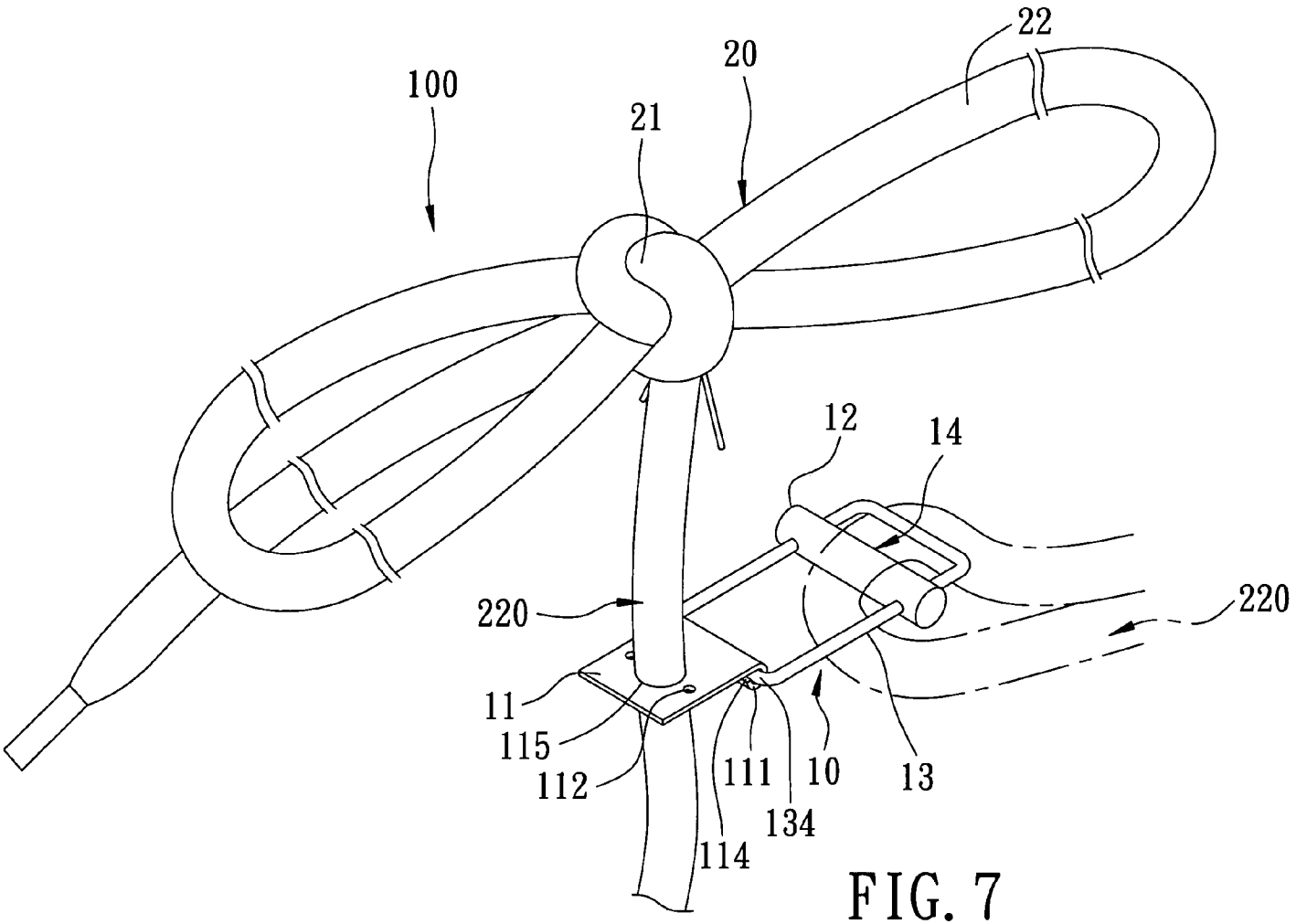
FIG. 7 is a perspective view of the second preferred embodiment of a fastener for a lace according to this invention.
Figure 8:
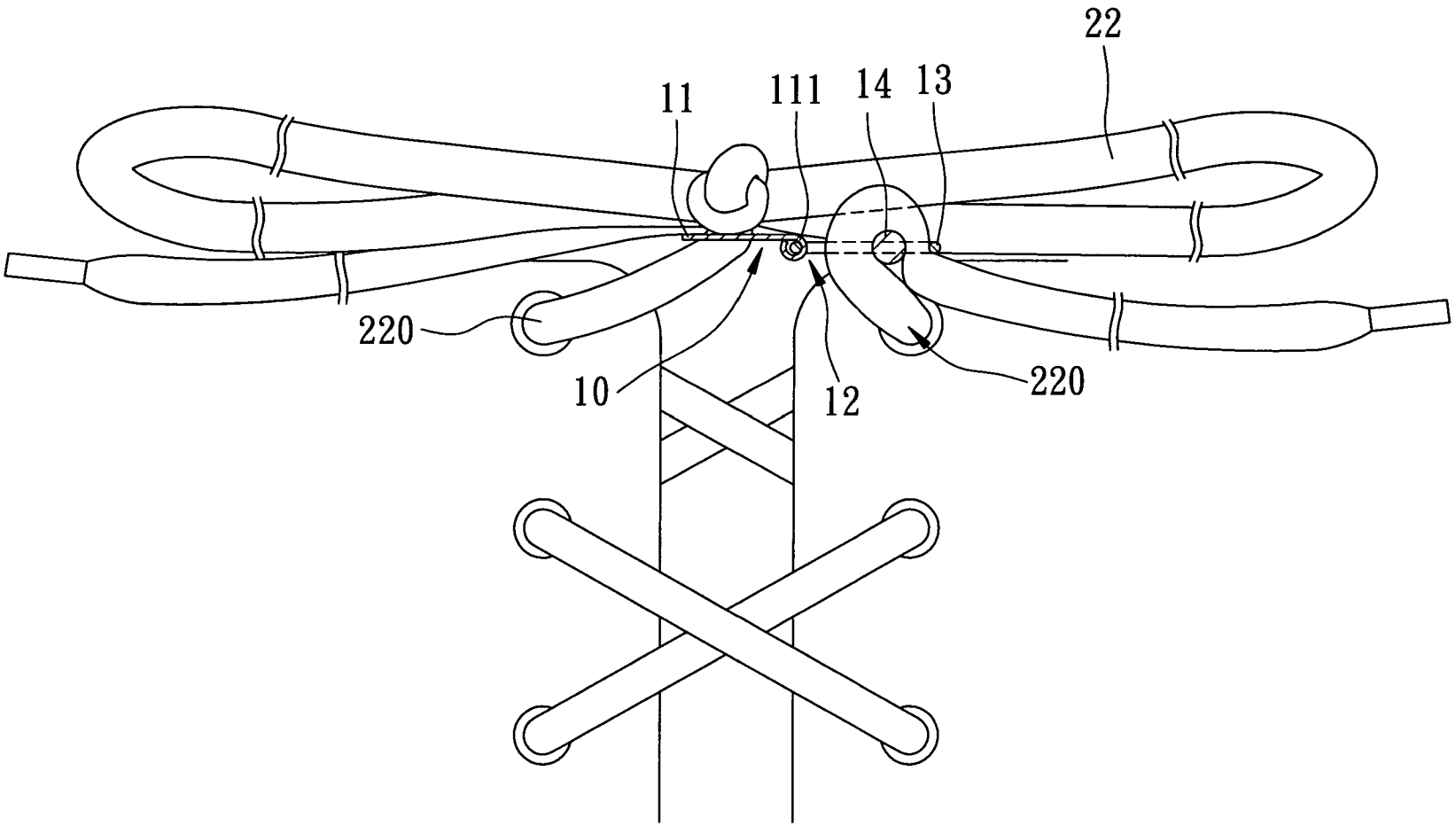
FIG. 8 is a schematic assembled sectional view of the second preferred embodiment to illustrate a tightening operation of a shoe that incorporates the second preferred embodiment.

Referring to FIGS. 7 and 8, the second preferred embodiment of a fastener 100 according to this invention is shown to be similar to the first preferred embodiment except for the following. The fastening body 10 includes the base 11 and a single clamp assembly 12. The base 11 has a single edge portion 111 rolled to form the sleeve defining the pivot hole 114 for inserting the pivoting ends 134 of the U-shaped member 13 therein. The base 11 further has a pair of the through holes 112 and a circular opening 115 between the through holes 112. The clamp member 14 is configured as a post. One of the distal lace segments is connected to the tying knot 21 of the pull unit 20 and passes through the circular opening 115 in the base 11. The U-shaped member 13 is connected to the corresponding one of the loops 22 of the pull unit 20.

Figure 9:
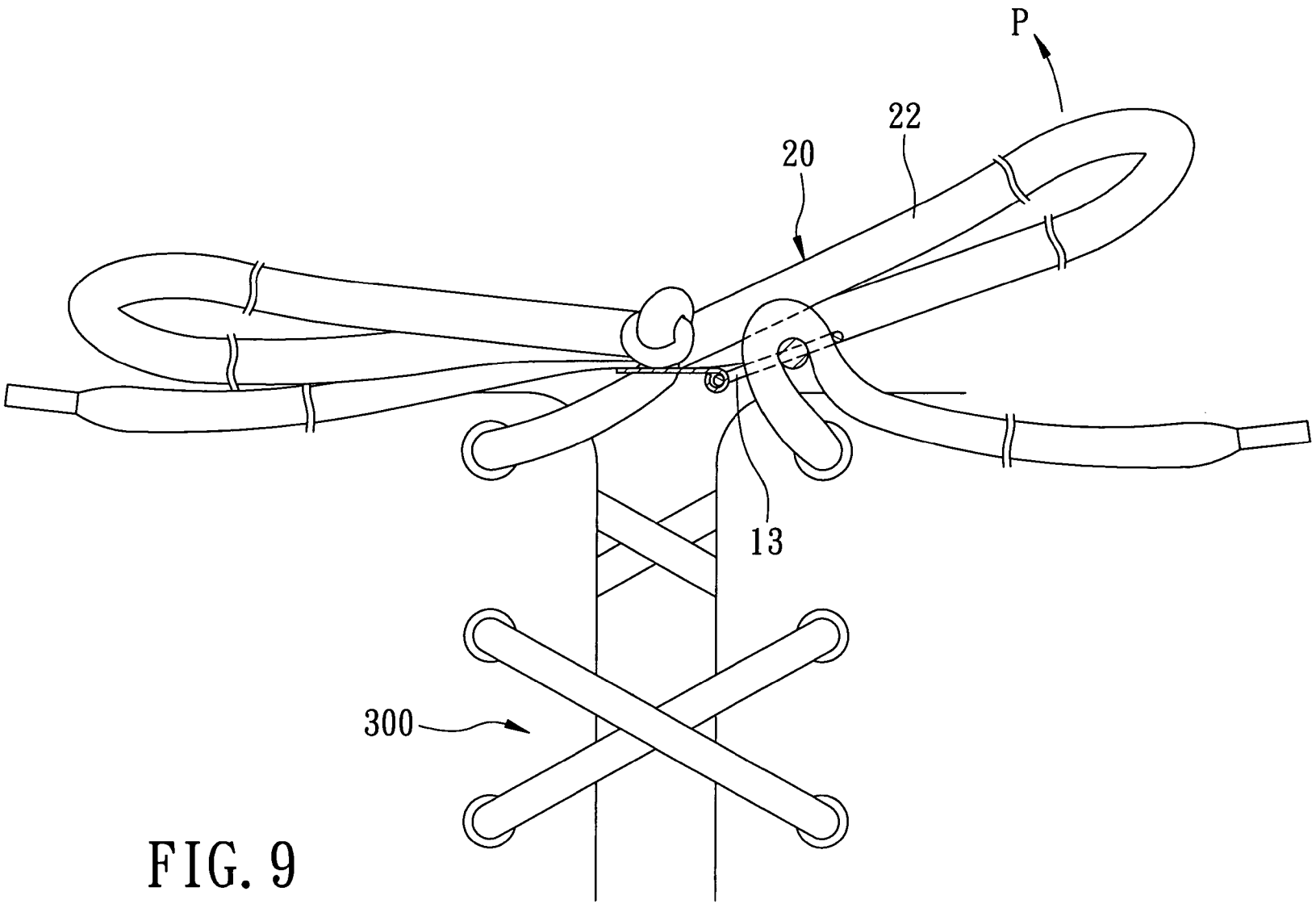
FIG. 9 is a view similar to FIG. 8, illustrating a loosening operation of the shoe.

Referring to FIG. 9, like the first preferred embodiment shown in FIG. 6, a manual pulling force is applied on one of the loops 22 of the pull unit 20 corresponding to the U-shaped member 13, as indicated by the arrow (P), to loosen the shoe body 300.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A fastener for a lace, comprising:

a fastening body including a base, and at least one clamp assembly having a substantially U-shaped member which has two pivoting ends pivotally connected to said base to define an opening with said base, and a clamp member which is attached slidably to said U-shaped member and which extends across said opening to divide said opening into a first aperture proximate to said base and a second aperture distal from said base, said U-shaped member having a U-bend which cooperates with said clamp member to confine said second aperture, said clamp member having two opposite ends respectively formed with slots, said U-shaped member having two sliding arms respectively extending through said slots between said base and said U-bend of said U-shaped member, said clamp member being slidable along said U-shaped member between a clamping position in which said clamp member moves toward said U-bend to clamp the lace against said U-bend for maintaining a tightened state of the lace, and a releasing position in which said clamp member moves away from said U-bend to permit loosening movement of the lace; and a pull unit connected to said U-shaped member for pulling said U-shaped member so that said clamp member can slide along said U-shaped member to said releasing position.

2. The fastener as claimed in claim 1, wherein said U-shaped member is rigid.

3. The fastener as claimed in claim 1, wherein said first aperture is adapted to receive an entry part of the lace, said second aperture being adapted to receive an exit part of the lace, said clamp member pressing the exit part of the lace against said U-bend of said U-shaped member when said clamp member is in said clamping position, said U-bend being attached to said pull unit.

4. The fastener as claimed in claim 1, wherein said fastening body includes a pair of said clamp assemblies pivotally connected to said base at two opposite sides of said base.

5. The fastener as claimed in claim 4, wherein said pull unit includes a tying knot connected to said base, and a pair of loops extending from said tying knot and connected respectively to said U-shaped members of said clamp assemblies.

6. The fastener as claimed in claim 5, wherein said pull unit further includes a plurality of anchoring elements for connecting each of said loops of said pull unit to said U-shaped member of a respective one of said clamp assemblies.

7. The fastener as claimed in claim 4, wherein said base includes a plate body, and two opposite edge portions, each of which is rolled to form a sleeve defining a pivot hole that receives said pivoting ends of said U-shaped member of a respective one of said clamp assemblies.

8. The fastener as claimed in claim 1, wherein said base includes a plate body, and at least one edge portion rolled to form a sleeve defining a pivot hole, said pivoting ends of said U-shaped member being inserted pivotally into said pivot hole.

9. A fastener for a lace, comprising:

a fastening body including:

a base having a plate body provided with a pivot hole; and at least one clamp assembly including a frame member that has a pivoting end inserted pivotally into said pivot hole and defining an opening, and a clamp member that is attached slidably to said frame member and that extends across said opening to divide said opening into a first aperture proximate to said base and a second aperture distal from said base, said frame member having a U-bend which cooperates with said clamp member to confine said second aperture, said clamp member being slidable along said frame member between a clamping position in which said clamp member moves toward said U-bend to clamp the lace against said U-bend for maintaining a tightened state of the lace, and a releasing position in which said clamp member moves away from said U-bend to permit loosening movement of the lace; and a pull unit connected to said frame member for pulling said frame member so that said clamp member can slide along said frame to said releasing position.

10. The fastener as claimed in claim 9, wherein said plate body of said base includes an edge which is rolled to form a sleeve defining said pivot hole.

11. The fastener as claimed in claim 9, wherein said frame member is substantially U-shaped.

* * * * *